United States Patent [19]

Yokomori et al.

[11] 4,280,063

[45] Jul. 21, 1981

[54] ELECTRONIC TIMER DEVICE

[75] Inventors: Mituo Yokomori, Shizuoka; Tsugimi Kawakami, Mishima, both of Japan

[73] Assignee: Tokyo Electric Co., Ltd., Tokyo, Japan

[21] Appl. No.: 78,810

[22] Filed: Sep. 25, 1979

[30] Foreign Application Priority Data

Oct. 4, 1978 [JP] Japan ..... 53-122269

[51] Int. Cl.[3] ..... G04B 47/00; G04F 8/00; H01H 3/34

[52] U.S. Cl. ..... 307/141.4; 368/107; 368/111; 368/10

[58] Field of Search ..... 58/33, 38, 39.5, 74, 58/152 R, 152 B; 307/293, 141.4; 361/173, 203; 368/10, 89, 109, 113

[56] References Cited

U.S. PATENT DOCUMENTS

| | | | |
|---|---|---|---|
| 3,809,970 | 5/1974 | Cook | 317/141 S |
| 3,869,854 | 3/1975 | Church | 58/33 |
| 3,882,670 | 8/1973 | Woolley | 58/39.5 |

*Primary Examiner*—Vit W. Miska

*Attorney, Agent, or Firm*—Frishauf, Holtz, Goodman and Woodward

[57] ABSTRACT

A timer device includes a counter which counts output pulses from an oscillator, and, when counting a prescribed number of pulses, sends forth an output signal, a transistor rendered conductive in response to the output signal from the counter, and a relay energized when the transistor is rendered conductive. A light-emitting diode connected is in parallel with the current path of the transistor to serve as an indicator as well as a latch for the relay.

10 Claims, 6 Drawing Figures

ELECTRONIC TIMER DEVICE

BACKGROUND OF THE INVENTION

This invention relates to an electronic timer device. In the prior art electronic timer, a counter is used to count an output signal issued from an oscillator and, upon lapse of the preset length of time, energize a relay. This relay is provided with a contact constituting a self-sustaining path and another contact for controlling the operation of a light-emitting diode designed to display the operating condition of the electronic timer. Moreover, the relay has to be provided with still another contact to control a load circuit. Thus, the prior art electronic timer has a complicated arrangement and is expensive. It has, therefore, been demanded to develop an electronic timer device whose relay can be maintained in a self-sustaining state without using a self-sustaining contact and whose operating condition can be displayed without applying a display control contact.

SUMMARY OF THE INVENTION

It is accordingly the object of this invention to provide an electronic timer device whose relay can be maintained in a self-sustaining state without using a contact. According to an aspect of this invention, there is provided an electronic timer device which comprises a frequency variable oscillating circuit, a counter circuit counting an output signal sent forth from the oscillating circuit, switching means whose operation is controlled by an output signal from the counter circuit, a relay circuit connected between the switching means and power supply terminal, and light-emitting means connected in parallel with the switching means for serving as an indicator as well as for maintaining the relay in a self-sustaining state even if the switching means is turned off.

DETAILED DESCRIPTION

Figure 2:
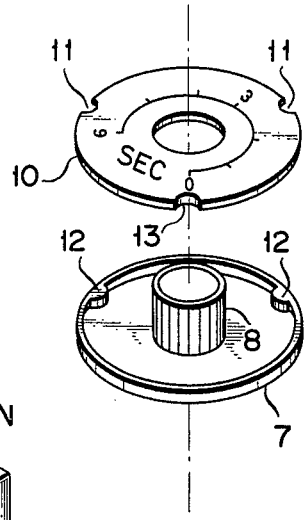
FIG. 2 illustrates a time-presetter included in the timer device of FIG. 1.
Figure 1:
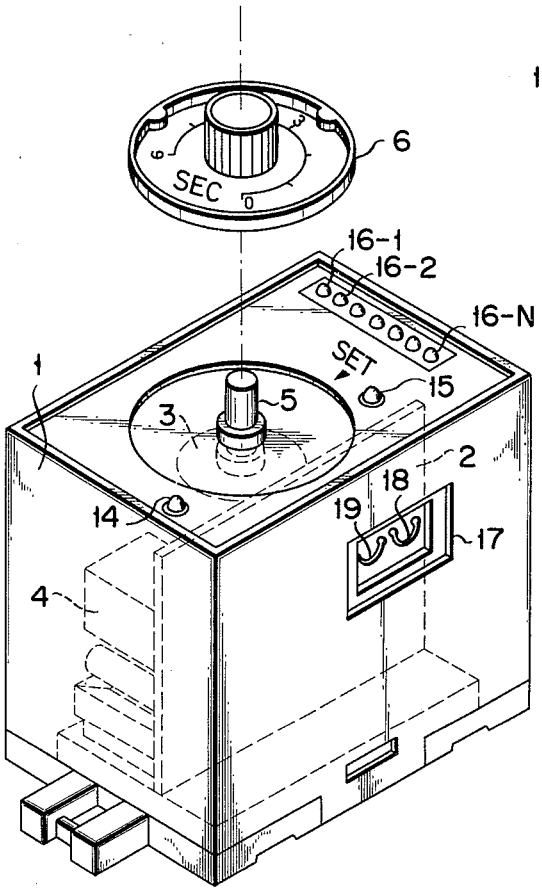
FIG. 1 shows a schematic external appearance of an electronic timer device embodying this invention.

FIG. 1 is a perspective view of the timer device of the invention. This timer device includes a case 1, a printed circuit board 2 received in the case 1, a rotary type variable resistor 3 mounted on the printed circuit board 2, and a circuit 4 including a frequency variable oscillator, frequency divider and counter as will be described later. A rotary shaft 5 of the rotary type variable resistor 3 protrudes through the upper plate of the case 1 to the outside. The rotary shaft 5 passes through a hole drilled at the center of an operation member 6. As illustrated in FIG. 2, the operation member 6 includes a disc 7 having an upwardly protruding peripheral edge, a knob 8 provided at the center of the disc 7, and a time-indicating graduated disc 10 to be fitted within the peripheral edge of the disc 7. The graduated disc 10 can be securely fitted to the disc 7 by engaging notches 11 formed at the peripheral edge of the graduated disc 10 with corresponding projections 12 directed inward from the upwardly protruding peripheral edge. The graduated disc 10 is further provided with a notch 13. When the forward end of a screw driver is forced into the notch 13 to catch the disc 10, the graduated disc 10 can be easily removed from the disc 7.

Mounted on the surface of the upper plate of the case 1 are a display element 14 for indicating the operating condition of the timer device, a display element 15 for indicating the lapse of a length of time preset in the timer device, and a plurality of display elements 16-1 to 16-N for displaying the successive periods in which the timer device is put into operation. One side wall of the case 1 is provided with an operation window 17. Access can be made through this operation window 17 to jumper lines 18 and 19 fitted to the printed circuit board to change the frequency division ratio of the frequency divider.

Figure 3:
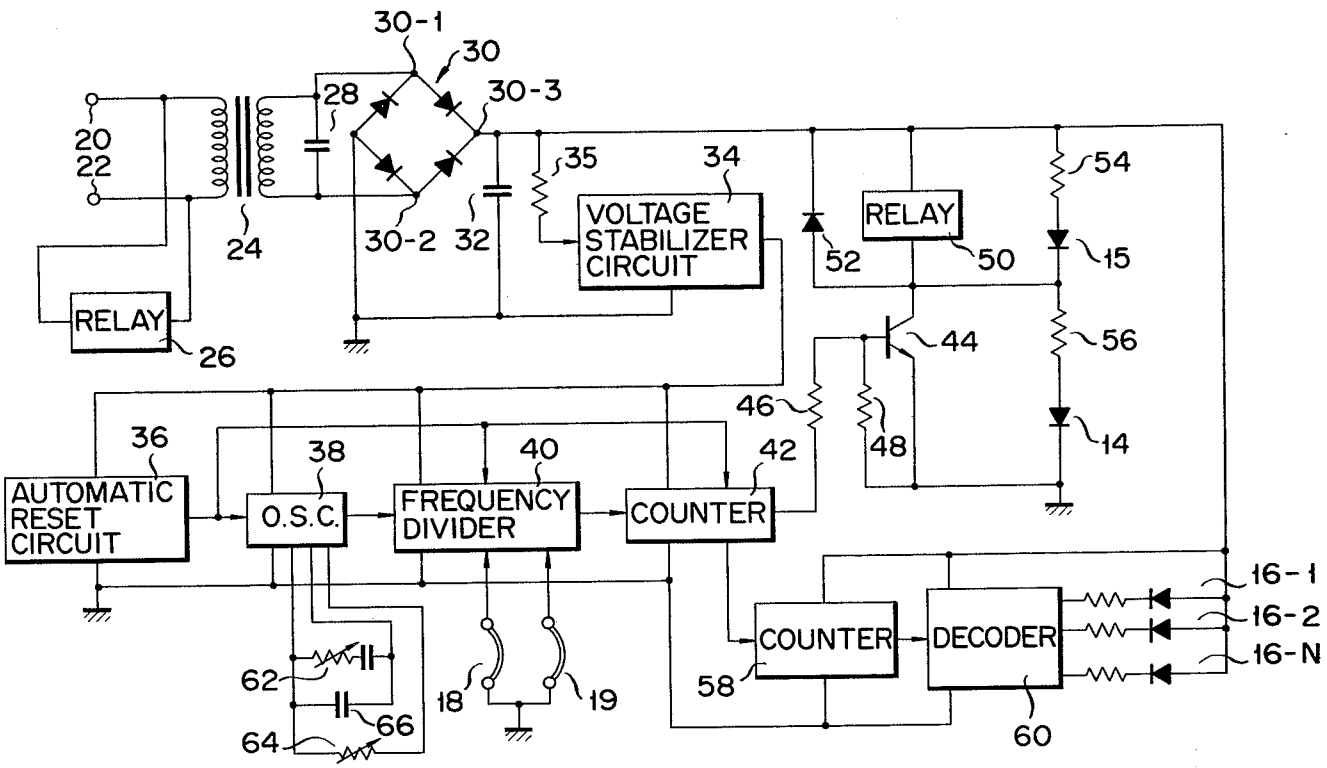
FIG. 3 is the circuit diagram of the timer device of FIG. 1.
Figure 4:
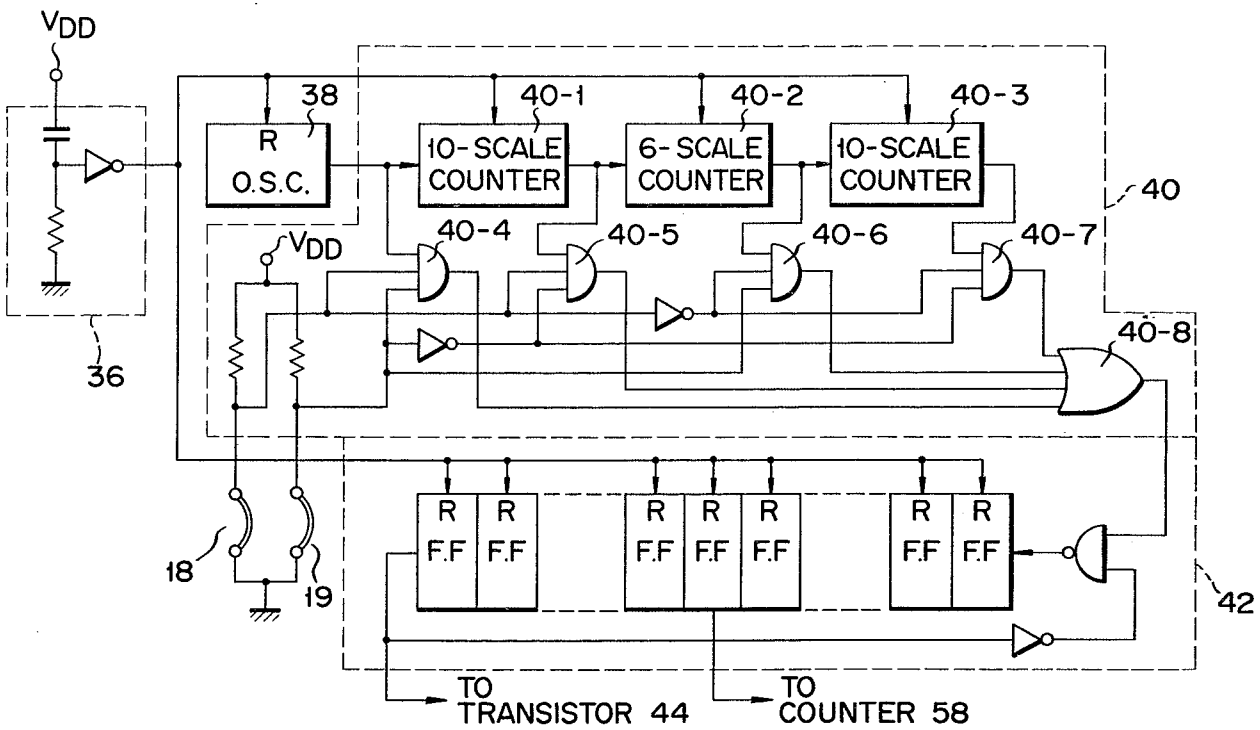
FIG. 4 is the detailed circuit diagram of a frequency divider included in the timer circuit of FIG. 3.

FIG. 3 shows the circuit arrangement of the timer device embodying the invention. The primary winding of a power supply transformer 24 and a relay 26 are connected between A.C. power supply terminals 20 and 22. Both terminals of the secondary winding of the power supply transformer 24 are connected to both terminals of the capacitor 28 and also to the A.C. input terminals 30-1 and 30-2 of a diode bridge rectifier 30. The output terminal 30-3 of the diode bridge rectifier 30 is connected to a smoothing capacitor 32 and also to a voltage stabilizer circuit 34 through a resistor 35. The voltage stabilizer circuit 34 supplies a constant voltage to an automatic reset circuit 36, frequency variable oscillator 38, frequency divider 40 for dividing the frequency of an output signal from the oscillator 38 and a counter 42 for counting an output signal sent forth from the frequency divider 40. The counter 42 is formed of, for example, series-connected flip-flop circuits as shown in FIG. 4. When the counter 42 counts a prescribed number, its first output terminal supplies an output signal to the base of an npn transistor 44 through a resistor 46.

The base of the npn transistor 44 is grounded through a resistor 48, and the emitter thereof is directly grounded. The collector of the npn transistor 44 is connected to the output terminal 30-3 of the diode bridge rectifier 30 through a relay 50. A diode 52 is connected in parallel with the relay 50 to prevent the npn transistor 44 from being destroyed by a surge voltage generated across the relay 50. A series circuit of a resistor 54 and a light-emitting diode 15 is connected between the output terminal 30-3 of the diode bridge rectifier 30 and the collector of the npn transistor 44. A series circuit formed of a resistor 56 and a light-emitting diode 14 is connected between the collector of the npn transistor 44 and ground.

The second output terminal of the counter 42, that is, the output terminal of one of the flip-flop circuits, issues one pulse each time the counter counts the prescribed number of output pulses from the frequency divider 40. In other words, output pulses from the frequency divider 40 are supplied to a counter 58 after proper frequency division. A decoder 60 (FIG. 3) for decoding the contents of the counter 58 energizes one of the light-emitting diodes 16-1 to 16-N in accordance with the contents of the counter 58.

Connected to the oscillator 38 are a variable resistor 62 and a time constant circuit formed of a variable resistor 64 and capacitor 66. Where the reference frequency of the oscillator 38 is set at, for example, 1024 Hz by the variable resistor 62 and the variable resistor 64 is properly controlled, then the variable oscillation frequency of the oscillator 38 can be changed within the range of, for example, 1024 Hz/6 to 1024 Hz. The variable resistor 64 corresponds to the variable resistor 3 of FIG. 1. The resistance of the variable resistor 64 can be changed by turning the knob 8. When counting 1024, the counter 42 holds this value. At this time, the first output terminal of the counter 42 sends forth an output signal of high voltage level. The counter 42 issues one pulse from its second output terminal each time input pulses are counted to, for example, a number of 1024/N.

The jumper lines 18 and 19 of FIG. 1 are connected to the frequency divider 40 to define the ratio of its frequency division. The frequency divider 40 includes cascade-connected 10-scale, 6-scale and 10-scale counters 40-1, 40-2 and 40-3 (FIG. 4), AND gates 40-4 to 40-7 respectively connected to the output terminals of the oscillator 38 and the counters 40-1 to 40-3 and selectively enabled in accordance with the condition of connection of the jumper lines 18 and 19, and OR gate 40-8 connected to the output terminals of the AND gates 40-4 to 40-7. While the jumper lines 18 and 19 are electrically shut off, that is, made in an open state, the frequency division ratio of the frequency divider 40 is set at 1. While the jumper line 18 is left open and the jumper line 19 is electrically connected, or closed, the frequency division ratio of the frequency divider 40 is set at 10. While the jumper line 18 is closed, and the jumper line 19 is opened, the frequency division ratio of the frequency divider 40 is set at 60. While both jumper lines 18 and 19 are closed, the frequency division ratio of the frequency divider 40 is set at 600.

Assume now that both jumper lines 18 and 19 are left open. Since, at this time, the frequency division ratio of the frequency divider 40 is set at 1, a length of time required for the counter 42 to count 1024 can be changed within the range of 1 second to 6 seconds by varying the resistance of the variable resistor 64. In other words, when the knob 8 is set at the 1-second position of the graduated disc 10 (FIG. 2), then the oscillator 38 sends forth an output oscillation signal having a frequency of 1024 Hz. When the knob 8 is set at the 6-seconds position of the graduated disc 10, then the oscillator 38 issues an oscillation signal having a frequency of 1024/6 Hz. Thus, in this case, the timer device can be preset at a length of time ranging from 1 second to 6 seconds.

While the jumper line 18 is opened and the jumper line 19 is closed, the frequency division ratio of the frequency divider 40 is set at 10, as described above. Therefore, a length of time required for the counter 42 to count 1024 is changed within the range of 10 to 60 seconds by varying the resistance of the variable resistor 64. Thus, the timer device can be preset at a length of time ranging from 10 to 60 seconds. In this case, the graduated disc 10 of FIG. 2 having 3-seconds and 6-seconds display positions is replaced by another graduated disc (not shown) having 30-seconds and 60-seconds at corresponding display positions.

Where the jumper line 18 is closed, and the jumper line 19 is opened, the frequency division ratio of the frequency divider 40 is set at 60. As a result, a length of time required for the counter 42 to count 1024 is changed within the range of 1 to 6 minutes by varying the resistance of the variable resistor 64. Thus, the timer device can be preset at a length of time ranging between 1 to 6 minutes. In this case, the graduated disc 10 of FIG. 2 having 3 seconds and 6 seconds display positions is replaced by another graduated disc (not shown) having 3 minutes and 6 minutes display positions.

Where both jumper lines 18 and 19 are closed, the frequency division ratio of the frequency divider 40 is set at 600. As a result, a length of time required for the counter 42 to count 1024 is changed within the range of 10 to 60 minutes by varying the resistance of the variable resistor 64. Thus, the timer device can be preset at a length of time ranging from 10 to 60 minutes. In this case, the graduated disc 10 of FIG. 2 having 3 minutes and 6 minutes display positions is replaced by another graduated disc (not shown) having 30 minutes and 60 minutes display positions.

There will now be described the operation of the timer device whose circuit arrangement is shown in FIG. 3. When A.C. power is supplied between the power supply terminals 20 and 22, the relay 26 is energized. As a result, an external circuit (not shown) connected to the relay 26 is put into operation. At this time, D.C. power is supplied to the voltage stabilizer circuit 34, relay 50, light-emitting diodes 15 and 14 through the output terminal 30-3 of the diode bridge rectifier 30. Since, under this condition, the transistor 44 remains nonconductive, current flowing through the relay 50 and current running through the light-emitting diode 15 are not large enough to energize the relay 50 and light-emitting diode 15. However, the sum of currents passing through the relay 50 and light-emitting diode 15 is large enough to energize the light-emitting diode 14, which in turn emits light, thereby visibly indicating the operating condition of the timer device.

The voltage stabilizer circuit 34 supplied with D.C. power from the output terminal 30-3 of the diode bridge rectifier 30 delivers a constant voltage to the automatic reset circuit 36, oscillator 38, frequency divider 40 and counter 42. When receiving a constant voltage from the voltage stabilizer circuit 34, the automatic reset circuit 36 issues a reset pulse to the oscillator 38, frequency divider 40 and counter 42 to cause these elements to regain the initial stage. When the automatic reset circuit 36 ceases to issue a reset pulse, an oscillation signal delivered from the oscillator 38 has its frequency divided in the ratio preset in the frequency divider 40. The frequency-divided oscillation signal is supplied to the counter 42. Where the oscillation frequency of the oscillator 38 is set at 1024 Hz and the frequency division ratio of the frequency divider 40 is set at 600, then the counter 42 receives one pulse at an interval of 600/1024. When the counter 42 counts pulses to a number of 1024/N, then the counter 42 produces a pulse from its second output terminal to increase the contents of the counter 58 by 1. The decoder 60 decodes the increased contents of the counter 58 and generates an output signal to energize the light-emitting diode 16-1. When the counter 42 counts a number of $2\times1024/N$, then the counter 42 produces a second pulse from its second output terminal to increase the contents of the counter 58 by 1. The decoder 60 decodes the increased contents and then generates an output signal to energize the light-emitting diode 16-2. Thus, the light-emitting diodes 16-1 to 16-N are successively energized, each time the count of the counter 58 is increased by 1. The particular one of the light-emitting diodes 16-1 to 16-N which emits light can roughly indicate a lapse of time from the start of the timer device and also a subsequent length of time to elapse before the preset time is brought to an end.

When the counter 42 counts up to 1024, that is, the preset time has passed, then the counter 42 produces from its first output terminal an output signal of high voltage level to render the transistor 44 conductive, and consequently energize the relay 50. An external circuit (not shown) connected to the contact of the energized relay 50 has its operation controlled by opening or closing the contact of the relay 50. In this case, the light-emitting diode 15 is supplied with sufficiently large current for its energization, and emits a light. On the other hand, the light-emitting diode 14 is shunted through the emitter collector path of the transistor 44, and deenergized. In other words, the light emitting diode 14 ceases to emit a light, and the light-emitting diode 15 emits a light instead, indicating that the operation of the timer device has been brought to an end. If the transistor 44 is rendered nonconductive by chance, the current energizing the relay 50 runs through the light-emitting diode 14, thus causing the relay 50 to be held in a self-sustaining state.

Figure 5:
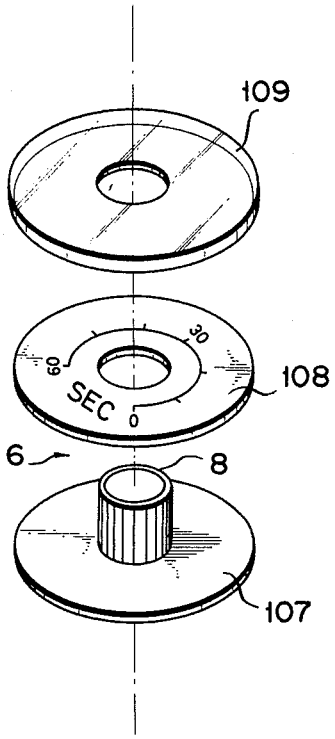
FIGS. 5 and 6 indicate modifications of the time presetter of FIG. 2.
Figure 6:
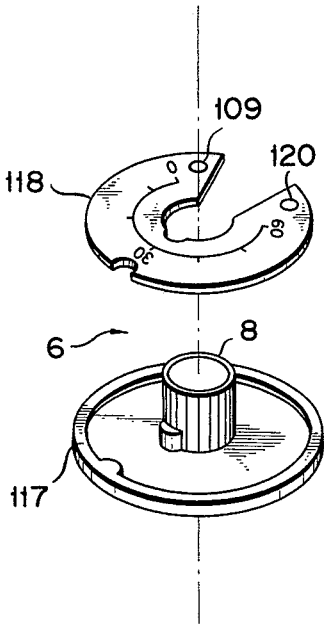

Description has been given of an embodiment of this invention. However, the invention is not limited thereto. According to the foregoing embodiment, a pair of jumper lines 18 and 19 were provided to preset the frequency division ratio of the frequency divider 40. However, one or three or more jumper lines may be used instead. Further, it is possible to replace the jumper lines by switches. The operation member 6 may also be constructed as shown in FIGS. 5 and 6. Referring to FIG. 5, the operation member includes a disc 107 having a knob 8 formed at the center, a graduated disc 108 having a hole provided at the outer through which the knob 8 is to be introduced, and an elastic transparent cover disc 109 which has a hole formed at the center and supports the graduated disc 108 jointly with the disc 107, with the hole penetrated by the knob 8 of the disc 107.

Referring to FIG. 6, the operation member 6 includes a disc 117 which has a knob 8 formed at the center and whose peripheral edge is provided with a contiguous upward extending projection, that is, whose cross section indicates a concave form, and a graduated elastic disc 118 fitted into the concave section. The graduated disc 118 has a hole formed at the center into which the knob 8 is to be introduced, and further a tapered notch radially extending from the control hole to the peripheral edge of the graduated disc 118 with the width of the notch progressively broadened toward the peripheral edge. Mutually facing holes 119 and 120 are formed near the opposite edges of the notch. The graduated disc 118 is fitted into the concave disc 117 by putting the ends of pincers into the mutually facing holes 119 and 120 by the hand and forcefully drawing the holes 119 and 120 near to each other and thereafter removing the pincers. Since the graduated disc 118 is elastic, the peripheral edges of the urged opposite portions of the notch elastically recoil upon release of the urging force of the hand to be tightly pressed against the inner peripheral wall of the knobbed concave disc 117, thereby ensuring the tight fitting of the graduated disc 118 to the knobbed concave disc 117. The graduated disc 118 is taken from the knobbed concave disc 117 by putting the ends of the pincers into the mutually facing holes 119 and 120 by the hand to draw them near to each other and vertically pulling the graduated disc 118 from the knobbed concave disc 117 without releasing the urging force of the hand in order to prevent the peripheral edges of the opposite portions of the notch from elastically recoiling and tightly abutting against the inner peripheral wall of the knobbed concave disc 117.

According to the foregoing embodiment, the light-emitting diodes 16-1 to 16-N were energized one after another with the preceding one de-energized, each time the count of the counter 58 is increased by 1. However, the light-emitting diodes 16-1 to 16-N may be so designed that they are energized in a number increased by 1, each time the count of the counter 58 is increased by 1, with all the preceding ones still remaining energized. Further, an output signal from the second output terminal of the counter 42 was supplied to the counter 58. However, it is possible to provide an additional frequency divider which divides the frequency of an output signal from the frequency divider 40 in the proper ratio, and supply an output signal from the additional frequency divider to the counter 58.

What we claim is:

1. A timer device comprising:

a power supply terminal;

a frequency variable oscillating circuit;

a counter circuit for counting an output signal from said oscillating circuit and generating a first output signal from a first output terminal thereof when the count of the counter circuit has reached a prescribed value;

switching means coupled to said first output terminal of said counter circuit and whose operation is controlled by said first output signal from said counter circuit;

a relay circuit connected between said power supply terminal and switching means and being energized responsive to a turn-on operation of said switching means; and first light-emitting diode means connected in parallel with said switching means and having a current voltage characteristic such that when said switching means is turned off after energization of said relay circuit, current flow through said first light-emitting diode means maintains said relay circuit energized, said current flow, however, being insufficient to initially energize said relay circuit from a de-energized state, said first light-emitting diode means emitting light when said relay circuit is de-energized and being extinguished when said relay circuit is energized by said switching means.

2. The timer device according to claim 1, further comprising a frequency dividing circuit connected between said oscillating circuit and said counter circuit; and means for manually varying the frequency division ratio of said frequency dividing circuit.

3. The timer device according to claim 2, wherein said oscillating circuit comprises:

a time constant circuit which includes a variable resistor whose resistance can be manually varied and a capacitor; and a detachable graduated disc having a variable rotational position which is varied in accordance with the varying of the variable resistor.

4. The timer device according to claim 3, wherein the graduated disc is provided with time-indicating graduations corresponding to length of time determined by the oscillation frequency of said oscillating circuit and the frequency division ratio of said frequency dividing circuit.

5. The timer device according to any one of claims 1, 2, or 3, further comprising second light-emitting means connected between said power supply terminal and said switching means.

6. The timer device according to any one of claims 1, 2 or 3, wherein said counter circuit has a second output terminal and generates a second output signal from its second output terminal each time said count of said counter circuit reaches said prescribed value; and said timer device further comprises a plurality of light-emitting elements; and energizing means coupled to said plurality of light-emitting elements and operated in response to said second output signal from said counter circuit for selectively energizing said plurality of light-emitting elements.

7. A timer device comprising:

a power supply terminal;

a frequency variable oscillating circuit;

said oscillating circuit including a time constant circuit having a variable resistor whose resistance can be manually varied and a capacitor, and a detachable graduated disc having a variable rotational position which is varied in accordance with the varying of the variable resistor;

a frequency dividing circuit coupled to said oscillating circuit and including means for manually varying the frequency division ratio thereof;

a counter circuit for counting an output signal from said frequency dividing circuit and generating a first output signal from a first output terminal thereof when the count of the frequency dividing circuit has reached a prescribed value;

switching means coupled to said first output terminal of said counter circuit and being controlled by said first output signal from said counter circuit;

a relay circuit connected between said power supply terminal and said switching means and being energized responsive to a turn-on operation of said switching means; and first light-emitting means connected in parallel with said switching means.

8. The timer device according to claim 7, wherein the graduated disc is provided with time-indicating graduations corresponding to length of time determined by the oscillation frequency of said oscillating circuit and the frequency division ratio of said frequency dividing circuit.

9. The timer device according to claim 7, further comprising second light-emitting means connected between said power supply terminal and said switching means.

10. The timer device according to claim 7, wherein said counter circuit has a second output terminal and generates a second output signal from its second output terminal each time said count of said counter circuit reaches said prescribed value; and said timer device further comprises a plurality of light-emitting elements; and energizing means coupled to said plurality of light-emitting elements and operated in response to said second output signal from said counter circuit for selectively energizing said plurality of light-emitting elements.

* * * * *